US010480759B2

(12) United States Patent
Lu et al.

(10) Patent No.: US 10,480,759 B2
(45) Date of Patent: Nov. 19, 2019

(54) LANTERN

(71) Applicant: Zhejiang Dingxin Arts & Crafts Co., Ltd., Taizhou (CN)

(72) Inventors: Nengxiao Lu, Taizhou (CN); Xiang Chen, Taizhou (CN)

(73) Assignee: ZHEJIANG DINGXIN ARTS & CRAFTS CO., LTD., Taizhou (CN)

( * ) Notice: Subject to any disclaimer, the term of this patent is extended or adjusted under 35 U.S.C. 154(b) by 266 days.

(21) Appl. No.: 15/412,071

(22) Filed: Jan. 23, 2017

(65) Prior Publication Data

US 2018/0094797 A1 Apr. 5, 2018

(30) Foreign Application Priority Data

Sep. 30, 2016 (CN) ..... 2016 1 0870799

(51) Int. Cl.

| | |
|---|---|
| ***F21V 3/02*** | (2006.01) |
| ***F21V 17/16*** | (2006.01) |
| ***F21L 19/00*** | (2006.01) |
| *F21V 37/02* | (2006.01) |

(52) U.S. Cl.

CPC ..... *F21V 17/16* (2013.01); *F21L 19/00* (2013.01); *F21L 19/006* (2013.01); *F21V 37/02* (2013.01)

(58) Field of Classification Search

CPC ..... F21V 1/06

See application file for complete search history.

(56) References Cited

U.S. PATENT DOCUMENTS

| | | | | |
|---|---|---|---|---|
| 3,162,377 | A * | 12/1964 | Hidetaro | F21V 1/06 362/320 |
| 5,629,057 | A * | 5/1997 | Wang | B44C 5/00 362/122 |
| 5,645,343 | A * | 7/1997 | Rinehimer | F21S 8/065 362/235 |
| 6,401,404 | B1 * | 6/2002 | Fillipp | B44C 5/00 362/249.04 |
| 6,474,843 | B2 * | 11/2002 | Shieh | B44C 5/00 362/227 |
| 6,960,004 | B1 * | 11/2005 | Hsieh | F21V 1/06 362/352 |
| 2015/0077980 | A1 * | 3/2015 | Coughlin | F21V 21/14 362/183 |
| 2015/0184825 | A1 * | 7/2015 | Chen | F21V 3/023 362/186 |

* cited by examiner

*Primary Examiner* — Andrew J Coughlin

(74) *Attorney, Agent, or Firm* — Hemisphere Law, PLLC; Zhigang Ma

(57) ABSTRACT

The disclosure relates to an art craft technical field, and more particularly to a lantern. The disclosure provides a lantern, including a top support ring, a bottom support ring and a plurality of wires disposed around the top support ring as well as the bottom support ring, two ends of the wires extend towards the top support ring and the bottom support ring respectively, a top end and a bottom end of the wire are fixedly connected with elastic components respectively, a top end of the elastic component on top of the wire and the top support ring are fixedly connected, a bottom end of the elastic component on bottom of the wire and the bottom support ring are fixedly connected. In the lantern of the disclosure, the top end and the bottom end of the wire are fixedly connected with one elastic component respectively.

8 Claims, 12 Drawing Sheets

LANTERN

TECHNICAL FIELD

The disclosure relates to an art craft technical field, and more particularly to a lantern.

DESCRIPTION OF RELATED ART

A conventional lantern can include a lantern skeleton and a lampshade around the lantern skeleton. The lantern skeleton is generally made out of iron wires, which includes a top support ring, a bottom support ring and a lantern pedestal connected with the bottom support ring. The sort of lanterns are commonly hung in indoor or outdoor situations for highlighting a festal mood. Lantern skeletons of the conventional lanterns are mostly fixed, resulting in a relatively large space required for storage after utilization. A new lampshade will be in need to be put on the lantern skeleton for re-utilization. The lantern has a problem that is inconvenient for a long-distance transport besides difficulty for storage. The fixed lantern is large in volume for transportation, which leads to small quantity on load for transport with the same volume, as a result, costs for transportation are relatively high.

A patent numbered CN202158520U disclosed a detachable lantern frame, including an upper supporting ring, a lower supporting ring and a plurality of lantern spokes. A lamp pedestal fixedly connected with the lower supporting ring is arranged in a lantern. The detachable lantern frame is characterized in that at least two sections of upper arc segments are arranged on the upper supporting ring, the diameter of the upper arc segments is the same with that of the upper supporting ring, and the upper arc segments are moveably connected with the upper supporting ring. At least two sections of lower arc segments are arranged on the lower supporting ring, the diameter of the lower arc segments is the same with that of the lower supporting ring, and the lower arc segments are movably connected with the lower supporting ring. And two ends of each lantern spoke are fixedly connected with the upper arc segments and the lower arc segments respectively. The patent has the advantages of convenience in collection and low costs in transportation. But the lantern frame is difficult to be assembled and disassembled.

SUMMARY

In order to solve the problems above, the disclosure provides a lantern convenient for storage with low costs in transport.

To achieve the advantages above, the disclosure provides a lantern, including a top support ring, a bottom support ring and a plurality of wires disposed around the top support ring as well as the bottom support ring, two ends of the wires extend towards the top support ring and the bottom support ring respectively, a top end and a bottom end of the wire are fixedly connected with elastic components respectively, a top end of the elastic component on top of the wire and the top support ring are fixedly connected, a bottom end of the elastic component on bottom of the wire and the bottom support ring are fixedly connected.

In an embodiment of a lantern of the disclosure, the elastic components are configured to rotate the wires around the top support ring and the bottom support ring in order to fold the wires.

In an embodiment of a lantern of the disclosure, the elastic components are further configured to recover the wires by elastic force deriving from folding the wires after removing external force from the elastic components.

In an embodiment of a lantern of the disclosure, the elastic components are springs.

In an embodiment of a lantern of the disclosure, the elastic components are flat springs, torsion springs, spiral extension springs or spiral compression springs.

In an embodiment of a lantern of the disclosure, the elastic components are made out of rubber.

In an embodiment of a lantern of the disclosure, the elastic components are spiral extension springs or spiral compression springs, the top support ring and the bottom support ring are defined with holes. The amount of holes is corresponding to the amount of the wires. Each of the holes accommodates a part of each of the elastic components.

In an embodiment of a lantern of the disclosure, the elastic components are spiral extension springs or spiral compression springs, the top support ring and the bottom support ring are configured with fixing rods, the amount of fixing rods is corresponding to the amount of the wires, each of the elastic components accommodates a part of each of the fixing rods.

In an embodiment of a lantern of the disclosure, the elastic components are close-wound helix springs, the close-wound helix springs have initial tension.

In an embodiment of a lantern of the disclosure, cross sections of the fixing rods and cross sections of the wires are round.

In the lantern of the disclosure, the top end and the bottom end of the wire are fixedly connected with one elastic component respectively, the top end of the elastic component on top of the wire and the top support ring are fixedly connected, the bottom end of the elastic component on bottom of the wire and the bottom support ring are fixedly connected, the volume of the lantern can be reduced by folding the wires.

DETAILED DESCRIPTION OF PREFERRED EMBODIMENTS

In order to further illustrate embodiments and effects of the disclosure to achieve the scheduled objective, preferred embodiments, structures, features and efficacy of the disclosure will be described in detail with reference to the accompanying drawings as follows.

Figure 1:
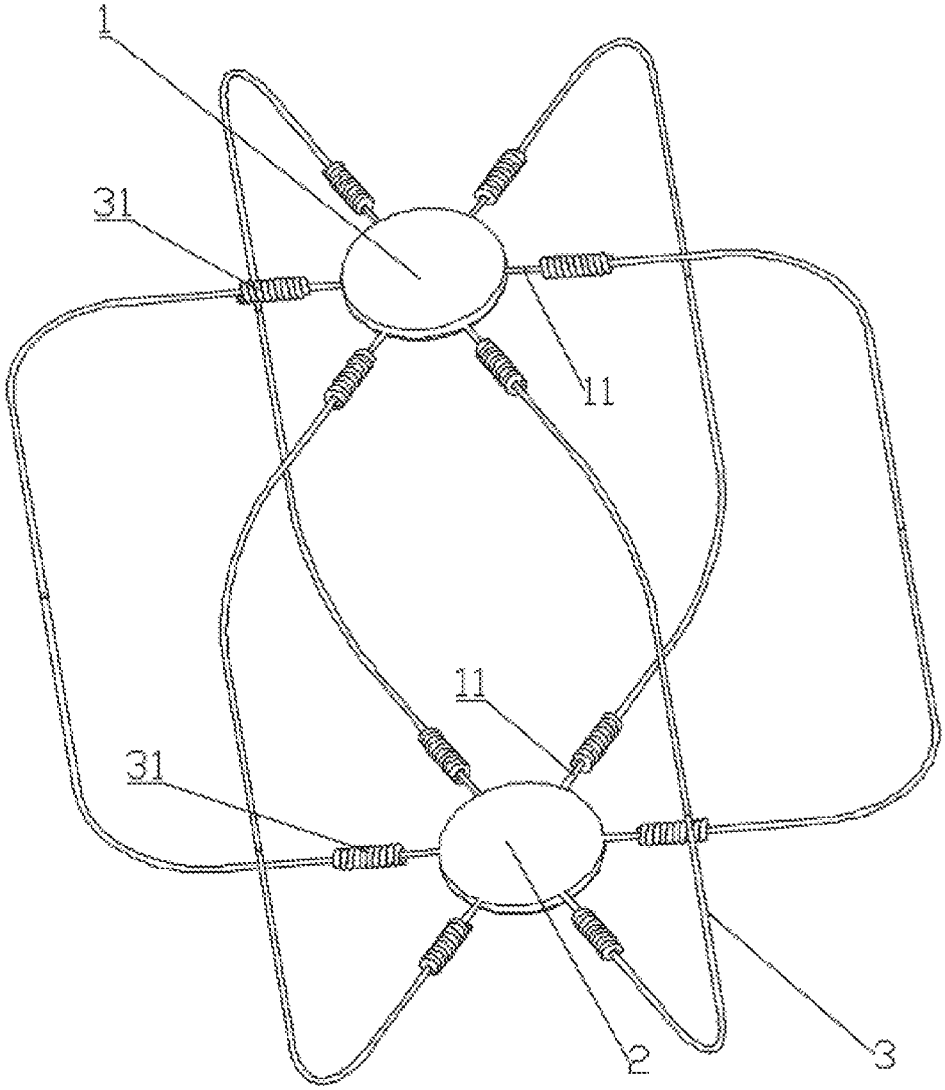
FIG. 1 is a structural view of an unfolded lantern according to a first embodiment of the disclosure.
Figure 2:
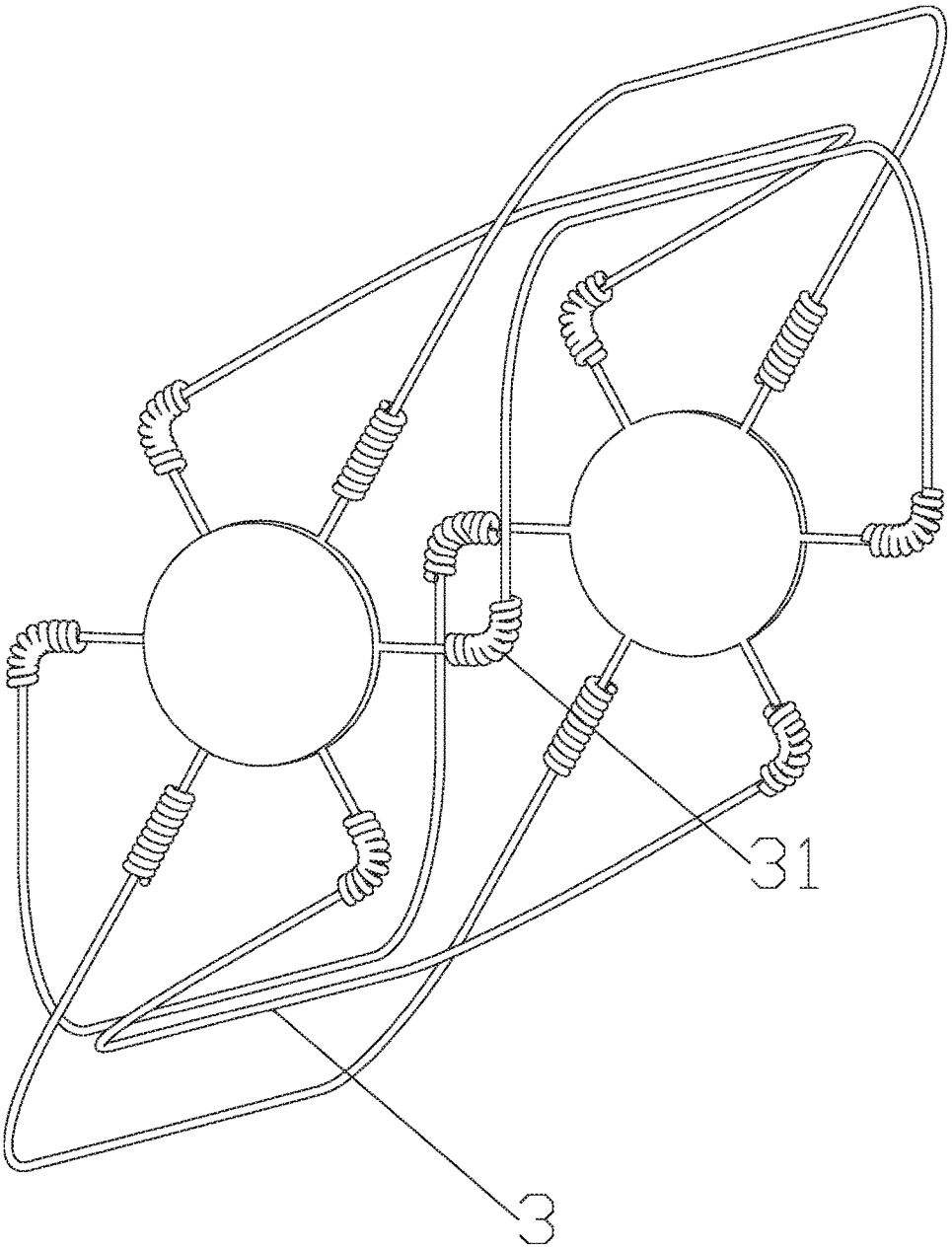
FIG. 2 is a structural view of a folded lantern according to FIG. 1.
Figure 3:
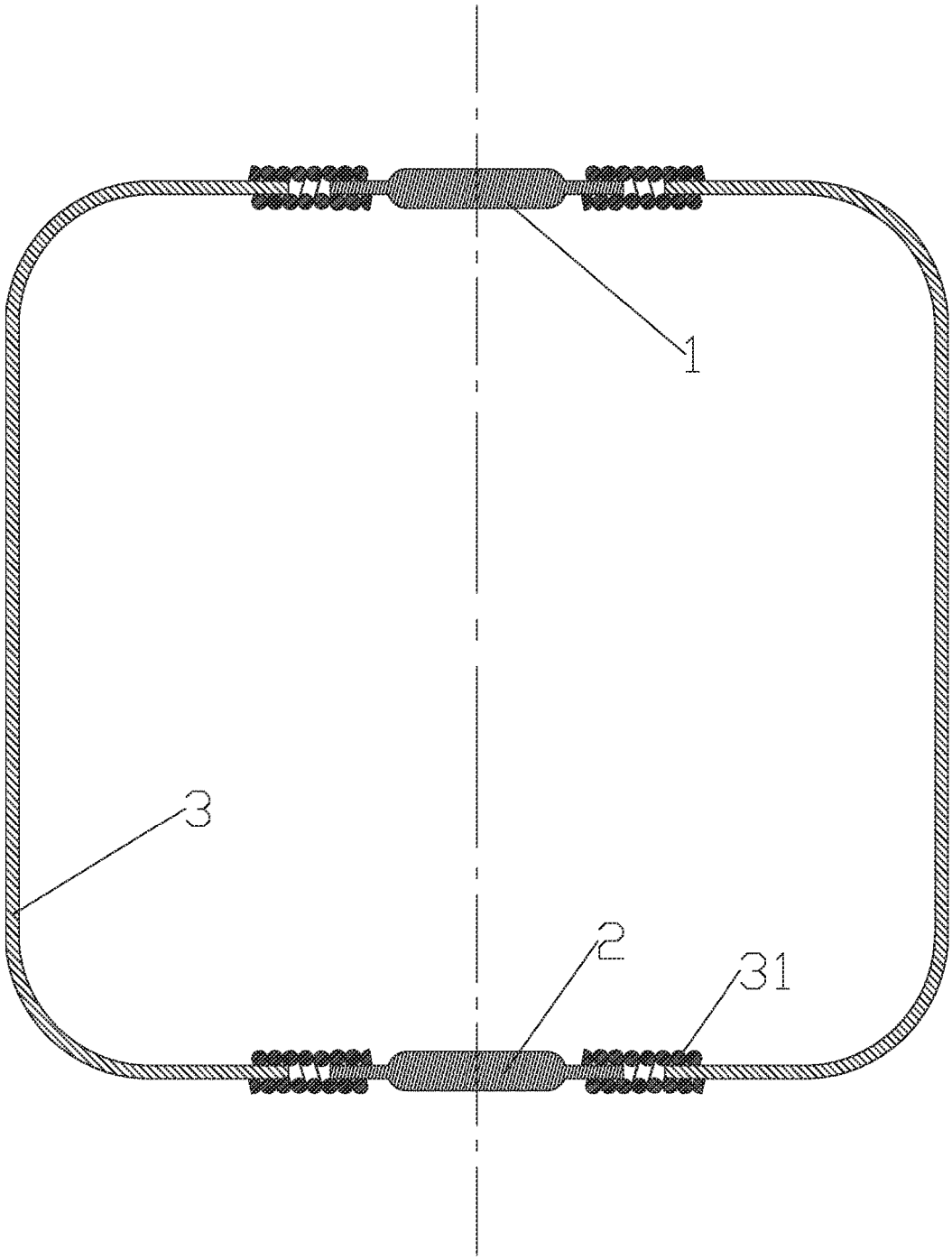
FIG. 3 is a cross-sectional view of the lantern of FIG. 1.

FIG. 1 is a structural view of an unfolded lantern according to a first embodiment of the disclosure. FIG. 2 is a structural view of a folded lantern according to FIG. 1. FIG. 3 is a cross-sectional view of the lantern of FIG. 1. Referring to FIG. 1 through FIG. 3, the lantern of the embodiment includes a top support ring 1, a bottom support ring 2 and a plurality of wires 3. The plurality of wires 3 are disposed around the top support ring 1 and the bottom support ring 2. Two ends of the wires 3 extend towards the top support ring 1 and the bottom support ring 2 respectively. A top end and a bottom end of the wire 3 are fixedly connected with an elastic component 31 respectively. A top end of the elastic component 31 on top of the wire 3 and the top support ring 1 are fixedly connected. A bottom end of the elastic component on bottom of the wire 3 and the bottom support ring 2 are fixedly connected.

The top support ring 1 and the bottom support ring 2 are both fixed with fixing rods 11. The amount of the fixing rods 11 is corresponding to the amount of the wires 3. Cross sections of the fixing rods 11 and cross sections of the wires 3 are round. In first embodiment of the disclosure, the elastic components 31 are close-wound helix springs. The close-wound helix spring has initial tension. The close-wound helix spring is a helical spring without gaps between coils. Tension of an extension spring to be pulled at a critical state between elastic deformation and original form is called the initial tension. The initial tension is achieved by controlling technological parameters during a cold rolling process of the extension spring.

Referring to FIG. 3, the elastic component 31 accommodates a part of the fixing rod 11 and a part of the wire 3. Two ends of the elastic component 31 are fixed with the fixing rod 11 and the wire 3 respectively. The elastic component 31 can be secured with the fixing rod 11 and the wire 31 by friction. In other embodiments of the disclosure, the elastic component 31 can be secured with the fixing rod 11 and the wire 31 by soldering.

Referring to FIG. 1 and FIG. 2, the elastic components 31 are configured to rotate the wires 3 around the top support ring 1 and the bottom support ring 2 to fold the wires 3. The elastic components 31 are further configured to recover the wires 3 by elastic force deriving from folding the wires 3 after removing external force from the elastic components 31.

Referring to FIG. 2, two symmetrical wires 3 in the lantern are fixedly connected with the top support ring 1 and the bottom support ring 2 directly, which can further play a role in reducing the volume of the lantern by folding.

Figure 4:
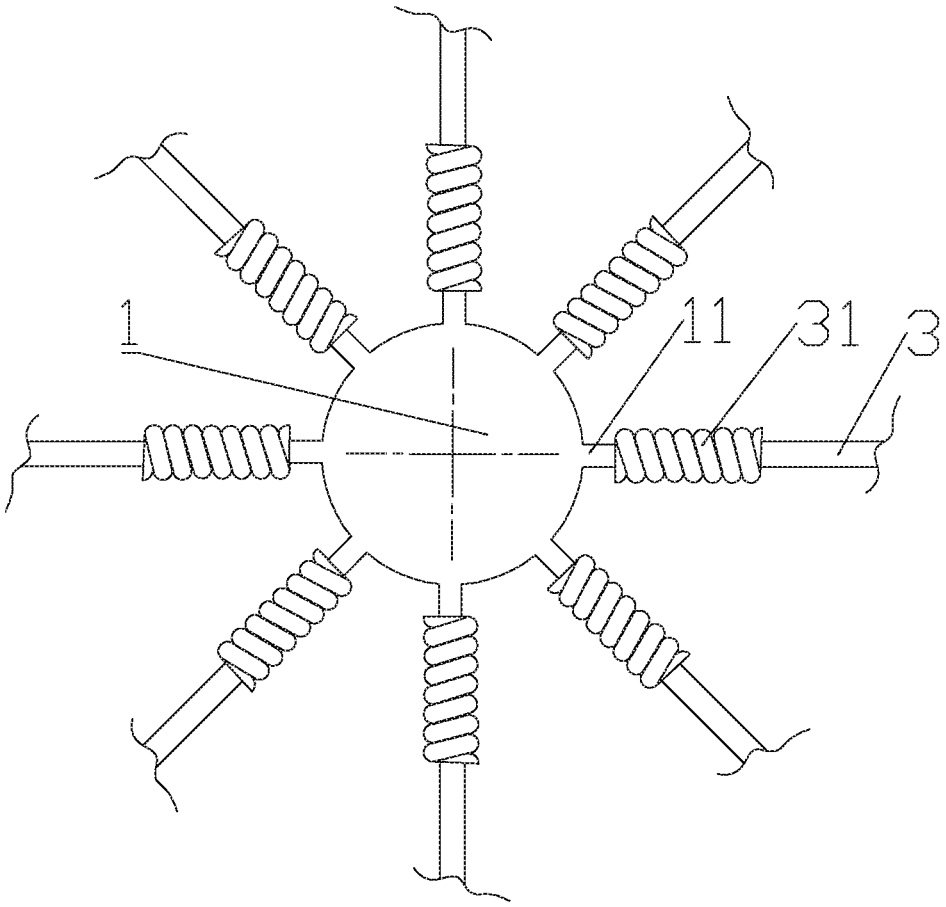
FIG. 4 is a structural view of a top support ring, elastic components and parts of wires of an unfolded lantern according to a second embodiment the disclosure.
Figure 5:
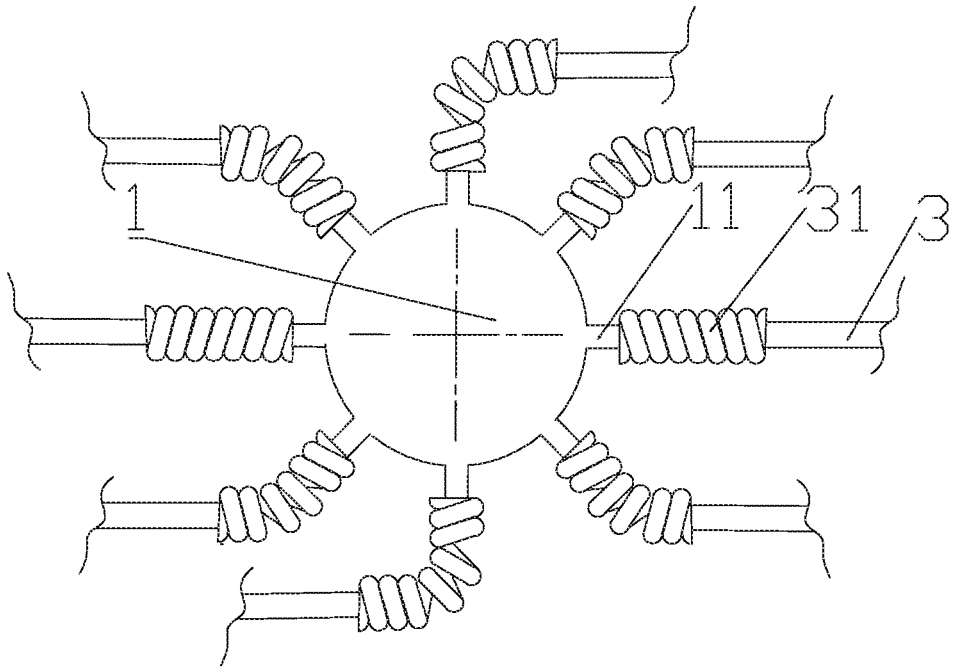
FIG. 5 is a structural view of the top support ring, the elastic components and parts of the wires of a folded lantern according to FIG. 4.

FIG. 4 is a structural view of a top support ring, elastic components and parts of wires of an unfolded lantern according to a second embodiment the disclosure. FIG. 5 is a structural view of the top support ring, the elastic components and parts of the wires of a folded lantern according to FIG. 4. The lantern according to the second embodiment of the disclosure is similar with the lantern according to the first embodiment of the disclosure. Referring to FIG. 4 and FIG. 5, the amount of wires in the embodiment is 8, the top support ring 1, the bottom support ring 2, the fixing rods 11, the wires 3 and the elastic components 31 in the embodiment can be all made out of steel.

Figure 6:
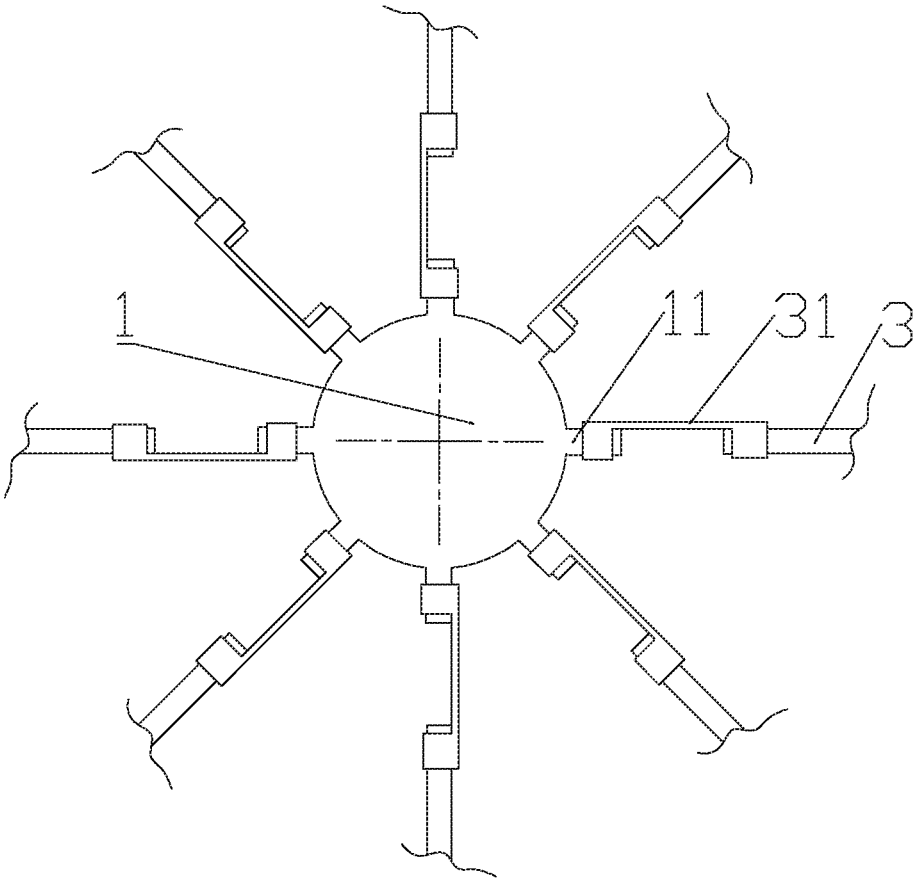
FIG. 6 is a structural view of a top support ring, elastic components and parts of wires of an unfolded lantern according to a third embodiment the disclosure.
Figure 7:
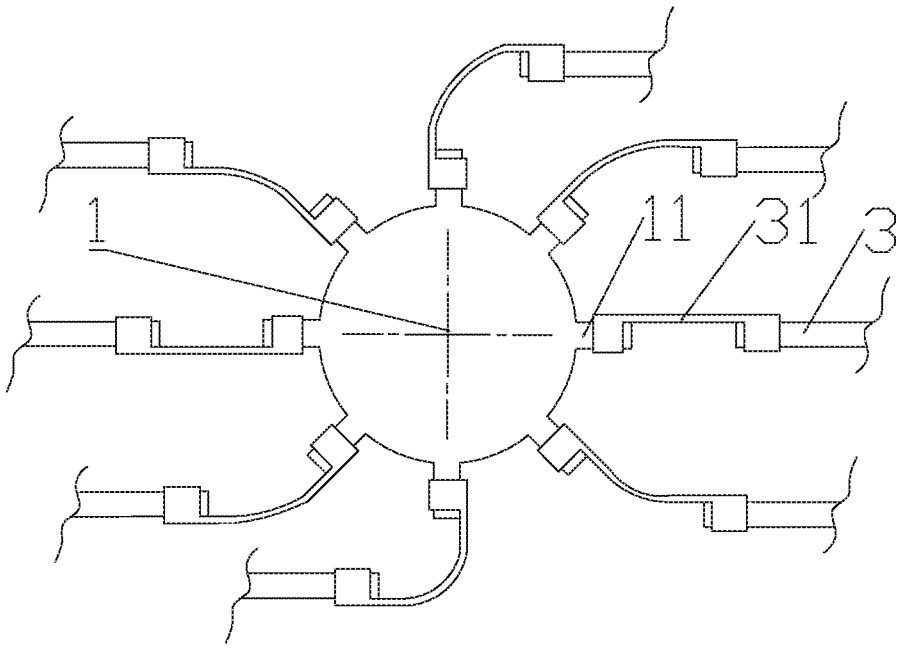
FIG. 7 is a structural view of the top support ring, the elastic components and parts of the wires of a folded lantern according to FIG. 6.

FIG. 6 is a structural view of a top support ring, elastic components and parts of wires of an unfolded lantern according to a third embodiment the disclosure. FIG. 7 is a structural view of the top support ring, the elastic components and parts of the wires of a folded lantern according to FIG. 6. The lantern according to the third embodiment of the disclosure is similar with the lantern according to the first embodiment of the disclosure. Referring to FIG. 6 and FIG. 7, the elastic components 31 in the embodiment are flat springs, two ends of the flat spring are tied up with the fixing rod 11 and the wire 3 respectively.

Figure 8:
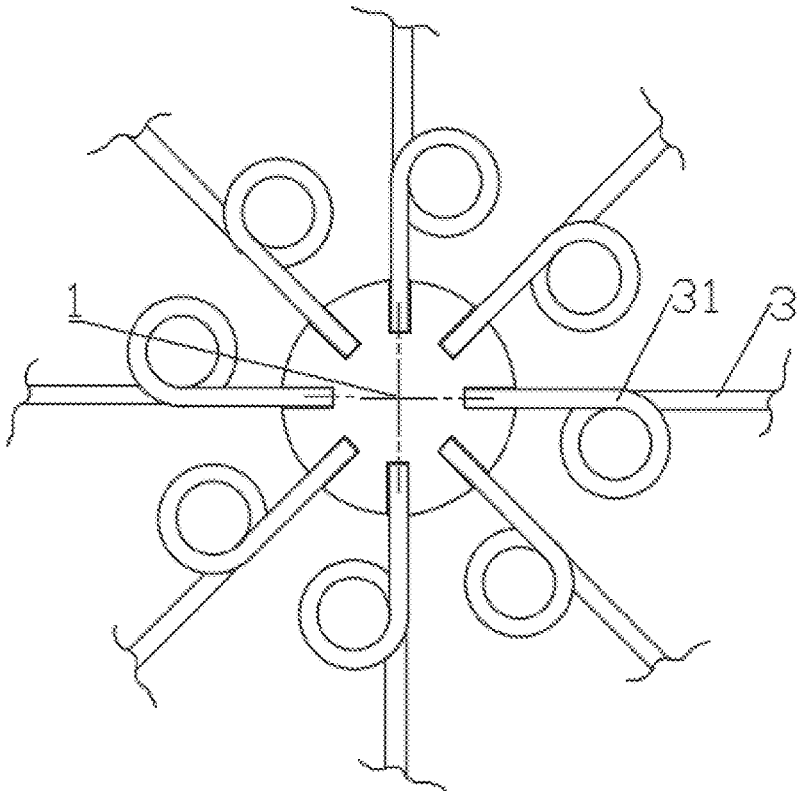
FIG. 8 is a structural view of a top support ring, elastic components and parts of wires of an unfolded lantern according to a fourth embodiment the disclosure.
Figure 9:
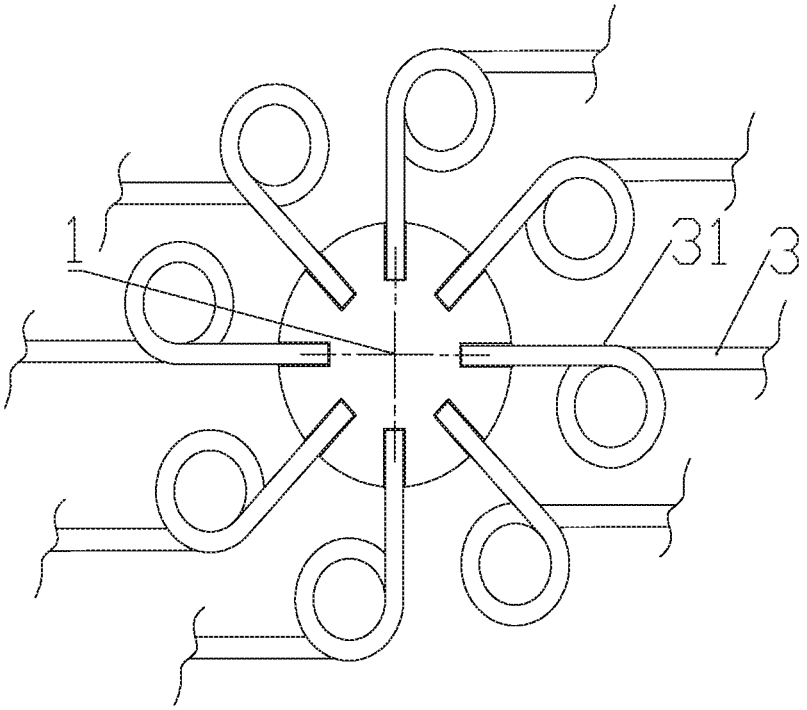
FIG. 9 is a structural view of the top support ring, the elastic components and parts of the wires of a folded lantern according to FIG. 8.

FIG. 8 is a structural view of a top support ring, elastic components and parts of wires of an unfolded lantern according to a fourth embodiment the disclosure. FIG. 9 is a structural view of the top support ring, the elastic components and parts of the wires of a folded lantern according to FIG. 8. The lantern according to the fourth embodiment of the disclosure is similar with the lantern according to the first embodiment of the disclosure. Referring to FIG. 8 and FIG. 9, disposal of the embodiment is free from the fixing rods, the elastic components 31 are torsion springs. The torsion spring and the wire 3 can be integrated, which means the torsion spring can be formed by bending a part of the wire. In other embodiments of the disclosure, the torsion springs and the wires can be made out of different material as well as being connected fixedly.

Figure 10:
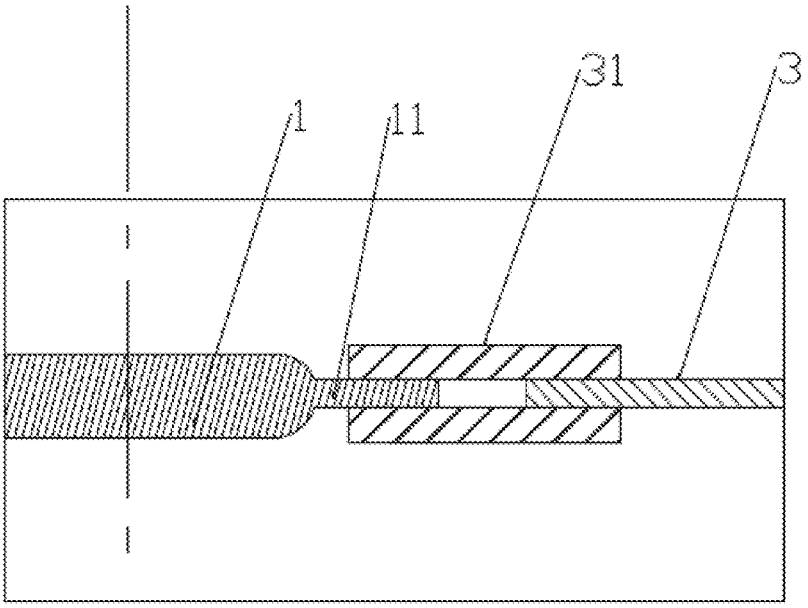
FIG. 10 is a cross-sectional view of a top support ring, an elastic component and a part of a wire of an unfolded lantern according to a fifth embodiment the disclosure.

FIG. 10 is a cross-sectional view of a top support ring, an elastic component and a part of a wire of an unfolded lantern according to a fifth embodiment the disclosure. The lantern according to the fifth embodiment of the disclosure is similar with the lantern according to the first embodiment of the disclosure. Referring to FIG. 10, in the embodiment, the elastic component 31 is made out of rubber, the elastic component 31 is a hollow tubular structure. The elastic component 31 accommodates a part of the wire 3 and a part of the fixing rod 11. The elastic component 31 can be fixedly connected with the fixing rod 11 and the wire 3 by friction. In other embodiments of the disclosure, the elastic component 31 can be fixedly connected with the fixing rod 11 and the wire 3 by adhesive.

Figure 11:
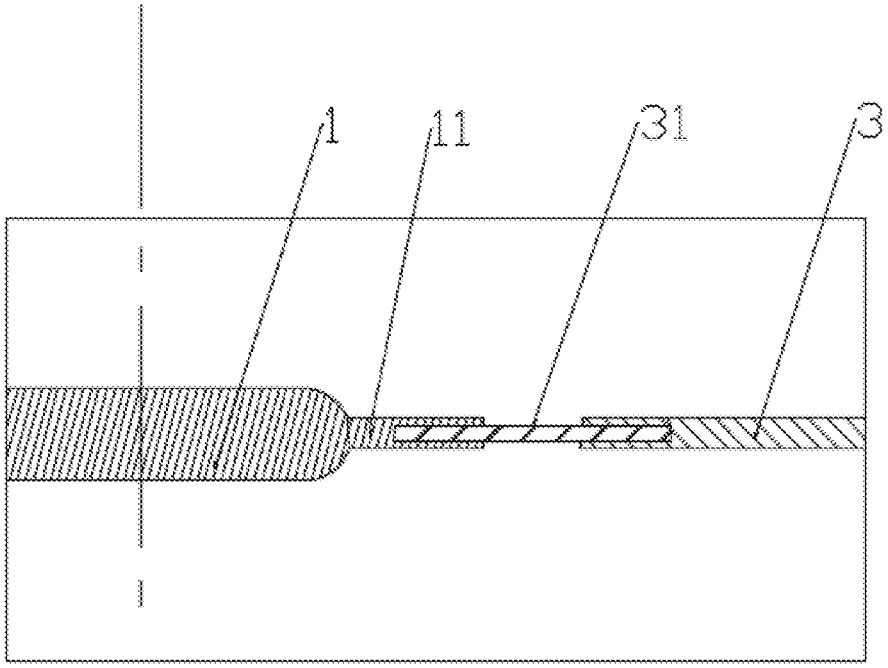
FIG. 11 is a cross-sectional view of a top support ring, an elastic component and a part of a wire of an unfolded lantern according to a sixth embodiment the disclosure.

FIG. 11 is a cross-sectional view of a top support ring, an elastic component and a part of a wire of an unfolded lantern according to a sixth embodiment the disclosure. The lantern according to the sixth embodiment of the disclosure is similar with the lantern according to the first embodiment of the disclosure. Referring to FIG. 11, in the embodiment, the elastic component 31 is made out of rubber, the elastic component 31 is a rod structure. An end of the fixing rod 11 and an end of the bottom support ring 3 are both defined with a hole to accommodate parts of the elastic component 31. The elastic component 31 can be fixedly connected with the fixing rod 11 and the wire 3 by friction. In other embodiment of the disclosure, the elastic component 31 can be fixedly connected with the fixing rod 11 and the wire 3 by adhesive.

In the second embodiment to the sixth embodiment of the disclosure, a connection manner of the top support ring 1 and the wire 3 is identical to the connection manner of the bottom support ring 2 and the wire 3.

Figure 12:
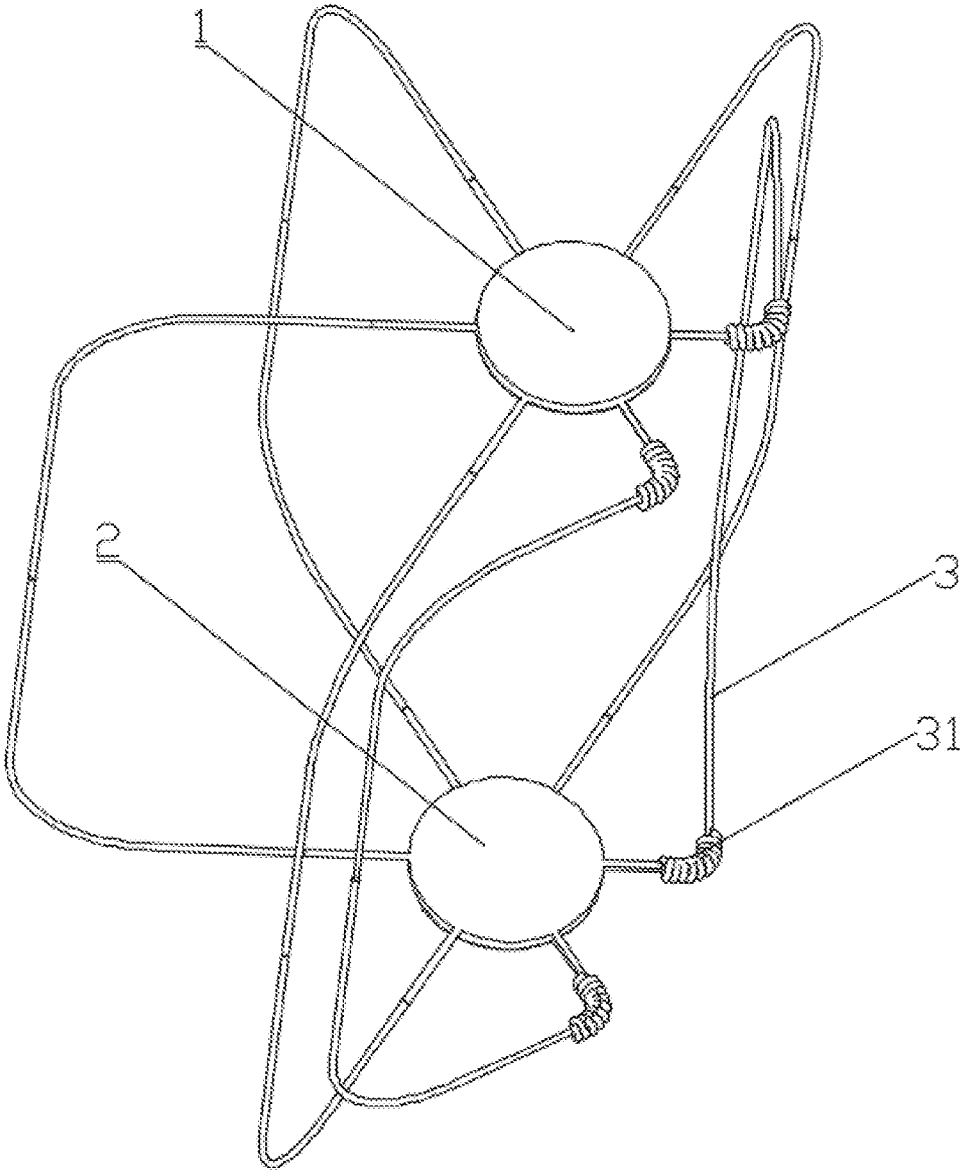
FIG. 12 is a structural view of a folded lantern according to a seventh embodiment the disclosure.
Figure 13:
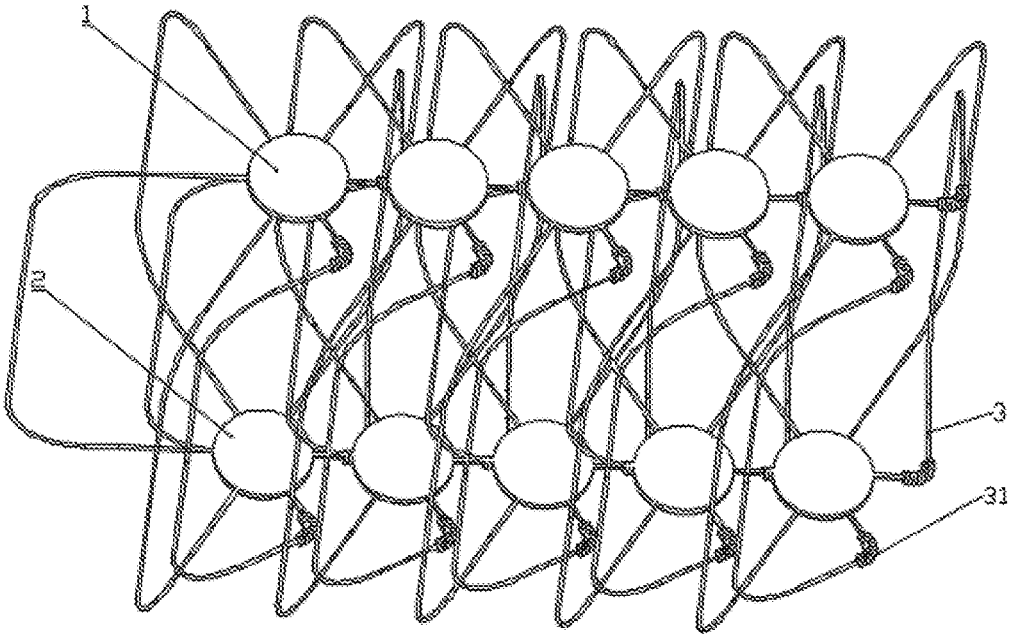
FIG. 13 is a structural view of overlapped lanterns shown in FIG. 12.

FIG. 12 is a structural view of a folded lantern according to a seventh embodiment the disclosure. FIG. 13 is a structural view of overlapped lanterns shown in FIG. 12. The lantern according to the seventh embodiment of the disclosure is similar with the lantern according to the first embodiment of the disclosure. Referring to FIG. 12, in the embodiment, only two adjacent wires 3 are disposed with elastic components 31 in ends, other wires are fixedly connected with the top support ring 1 and the bottom support ring 2 directly. The folded lantern is a bowl structure after the two adjacent wires 3 have been folded. The bowl structure of the folded lantern has an opening. The bowl structure with the opening can accommodate a part of another lantern. By this way, multiple folded lanterns can be overlapped to spare space for storage. An objective of reducing the space to store the lanterns can be achieved.

It can be inferred that the lantern with more wires can be folded to be bowl structured by folding portion of the wires to accommodate a part of another lantern.

Figure 14:
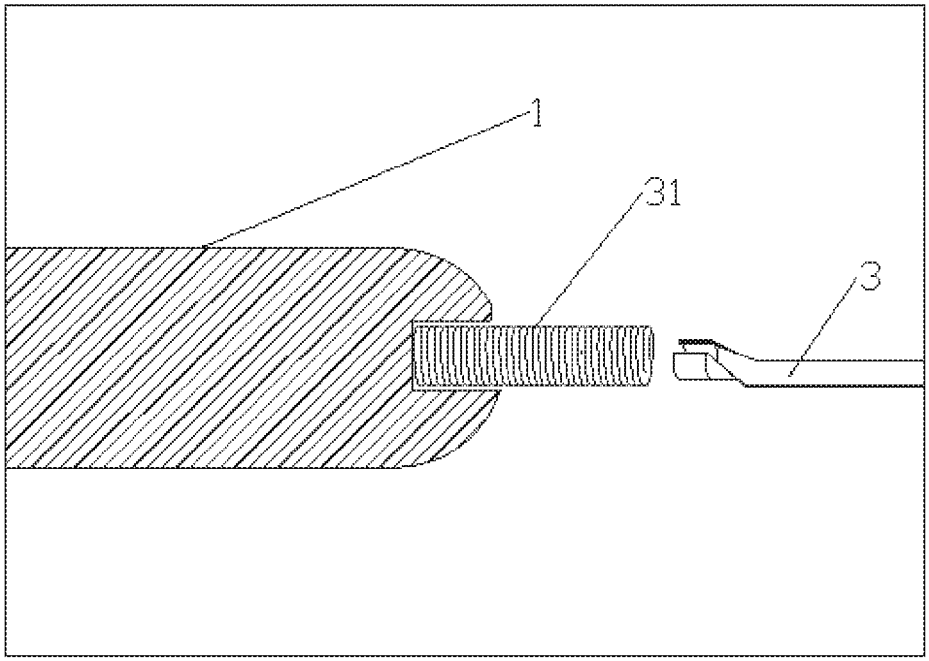
FIG. 14 is a cross-sectional view of a top support ring, an elastic component and a part of a wire of an unfolded lantern according to an eighth embodiment the disclosure.

FIG. 14 is a cross-sectional view of a top support ring, an elastic component and a part of a wire of an unfolded lantern according to an eighth embodiment the disclosure. The lantern according to the eighth embodiment of the disclosure is similar with the lantern according to the first embodiment of the disclosure. Referring to FIG. 14, in the embodiment, disposal of the embodiment is free from the fixing rods. The top support ring 1 is made out of plastic, and the top support ring 1 is defined with a hole to accommodate a part of the wire 3. The wire 3 is made by an iron sheet, a cross section of the wire 3 is rectangular. An end of the wire 3 is bent to form an arced internal surface. The corresponding arced external surface can be fit in the elastic component 31 in order to improve fixed connection with the elastic component 31. In other embodiment of the disclosure, the cross section of the wire 3 is rectangular, an end of the wire 3 is bent to form an arced internal surface, the arced internal surface is configured to wrap a part of the elastic component 31.

Figure 15:
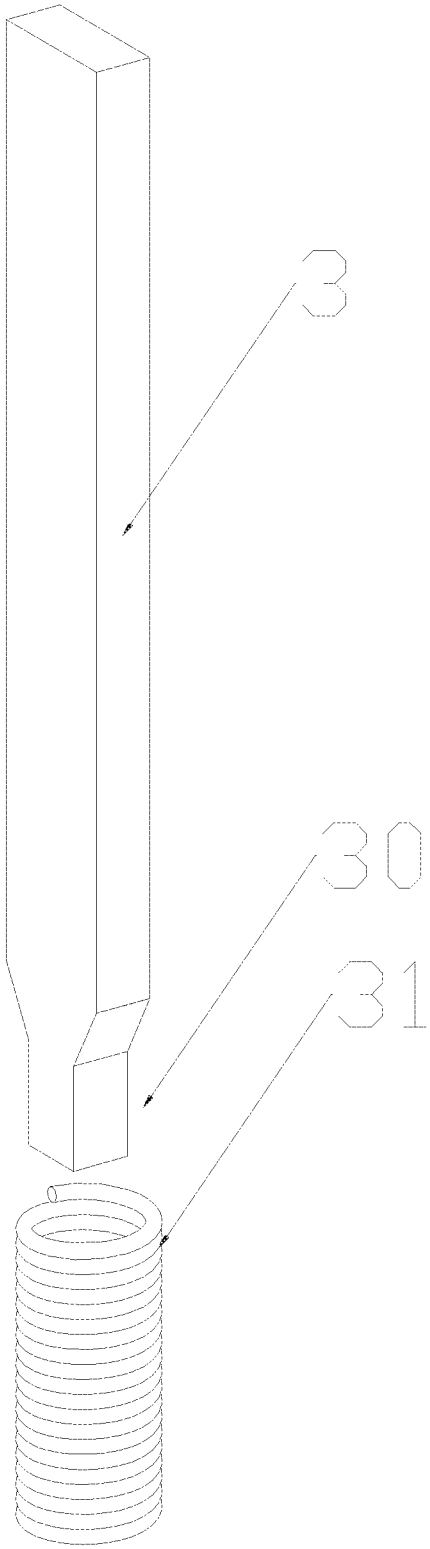
FIG. 15 is a perspective view of an elastic component and a part of a wire according to a ninth embodiment of the disclosure.

FIG. 15 is a perspective view of an elastic component and a part of a wire according to a ninth embodiment of the disclosure. The lantern according to the ninth embodiment of the disclosure is similar with the lantern according to the first embodiment of the disclosure. Referring to FIG. 15, in the embodiment, a cross section of the wire 3 is rectangular, an end 30 of the wire 3 is extruded or cut to be a rectangular cross section tangent to an internal surface of the elastic component 31. The elastic component 31 can be the close-wound helix spring, and the end 30 of the wire 3 has 4 lines contacting with the elastic component 31.

In other embodiments of the disclosure, the end of the wire 3 can form a cross section perfectly attached on the internal surface of the close-wound helix spring by extrusion, so that the end of the wire and the close-wound helix spring are surface contacted.

In other embodiments of the disclosure, the elastic components are springs. The springs can be made out of metal or other elastic material. When the springs, the fixing rods and the wires are all made out of metal, especially homogeneous steel, the springs, the fixing rods and the wires can be fixed by soldering.

In other embodiment of the disclosure, the elastic components are spiral compression springs.

Although the amount of wires in each embodiment of the disclosure is 6 or 8, it will be clear to a person skilled in the art that the lantern with more than two wires can be folded to achieve goals of reducing the space for storage and transport as well as saving packaging material by folding.

Overall, the lantern of the disclosure at least includes following advantages.

In the lantern of the disclosure, the top end and the bottom end of the wire are fixedly connected with one elastic component respectively. The top end of the elastic component on top of the wire and the top support ring are fixedly connected, the bottom end of the elastic component on bottom of the wire and the bottom support ring are fixedly connected. The volume of the lantern can be reduced by folding the wires.

In an embodiment of a lantern of the disclosure, the elastic components are spiral extension springs or spiral compression springs. The top support ring and the bottom support ring are both fixed with fixing rods. The amount of fixing rods is corresponding to the amount of the wires. The elastic component accommodates a part of the fixing rod and a part of the wire. A contact area of the elastic component and the fixing rod or the wire is larger, which is benefit for fixation of the elastic component and the fixing rod or the wire.

In an embodiment of a lantern of the disclosure, the elastic components are close-wound helix springs, the close-wound helix springs have initial tension. The close-wound helix springs can guarantee relative positions of the wires, the top support ring and the bottom support ring precisely when the wires are recovered from folded positions.

In an embodiment of a lantern of the disclosure, cross sections of the fixing rods and cross sections of the wires are round. The contact area of the elastic component and the fixing rod or the wire is larger, which is benefit for fixation of the elastic component and the fixing rod or the wire.

The above description illustrates preferred embodiments of the invention rather than any limitation, though the preferred embodiments are disclosed previously, the invention needs not be limited to the disclosed embodiments. For those skilled persons in the art, various modifications and variations can be made according to the concept of the invention. It is intended to cover various modifications and similar arrangements included within the spirit and scope of the appended claims that are to be accorded with the broadest interpretation so as to encompass all such modifications and similar structures.

What is claimed is:

1. A lantern, comprising a top support ring, a bottom support ring and a plurality of wires, the plurality of wires disposed around the top support ring and the bottom support ring, two ends of the wires extending towards the top support ring and the bottom support ring respectively, wherein a top end and a bottom end of the wire each are fixedly connected with an elastic component, the top support ring and the bottom support ring are configured with fixing rods each extending from a corresponding one of the top support ring and the bottom support ring outwardly, the amount of the fixing rods is corresponding to the amount of the wires, a top end of the elastic component on top of the wire accommodates an end of a corresponding one of the fixing rods away from the top support ring therein, a bottom end of the elastic component on bottom of the wire accommodates an end of a corresponding one of the fixing rods away from the bottom support ring therein;

wherein the lantern is at a folded state when the elastic components for more than one of the plurality of wires are bent in the circumferential direction of the top support ring, and the lantern is capable of recovering from the folded state to an unfolded state by elastic force deriving from the bent elastic components after removing external force from the elastic components.

2. The lantern according to claim 1, wherein the elastic components are springs.

3. The lantern according to claim 2, wherein the elastic components are flat springs, torsion springs, spiral extension springs or spiral compression springs.

4. The lantern according to claim 2, wherein the elastic components are made out of rubber.

5. The lantern according to claim 1, wherein the elastic components are close-wound helix springs; the close-wound helix springs have initial tension.

6. The lantern according to claim 1, wherein cross sections of the fixing rods and cross sections of the wires are round.

7. A lantern, comprising a top support ring, a bottom support ring and a plurality of wires, the plurality of wires disposed around the top support ring and the bottom support ring, two ends of the wires extending towards the top support ring and the bottom support ring respectively, wherein a top end and a bottom end of the wire each are fixedly connected with an elastic component, a top end of the elastic component on top of the wire and the top support ring fixedly connected, a bottom end of the elastic component on bottom of the wire and the bottom support ring fixedly connected;

wherein the lantern is at a folded state when the elastic components for more than one of the plurality of wires are bent in the circumferential direction of the top support ring, and the lantern is capable of recovering from the folded state to an unfolded state by elastic force deriving from the bent elastic components after removing external force from the elastic components;

wherein the top support ring and the bottom support ring are configured with fixing rods, the amount of the fixing rods is corresponding to the amount of the wires, each of the elastic components accommodates a part of a corresponding one of the fixing rods.

8. The lantern according to claim 7, wherein the top support ring and the bottom support ring are defined with holes, the amount of the holes is corresponding to the amount of the wires, each of the holes accommodates a part of a corresponding one of the elastic components.

* * * * *